US005277036A

United States Patent [19]

Dieckmann et al.

[11] Patent Number: 5,277,036

[45] Date of Patent: Jan. 11, 1994

[54] MODULAR AIR CONDITIONING SYSTEM WITH ADJUSTABLE CAPACITY

[75] Inventors: John J. Dieckmann, Harrisonburg, Va.; Joseph Intagliata, St. Louis, Mo.

[73] Assignee: Unico, Inc., St. Louis, Mo.

[21] Appl. No.: 6,451

[22] Filed: Jan. 21, 1993

[51] Int. Cl.[5] ..... F25D 21/14

[52] U.S. Cl. ..... 62/29; 62/298; 165/76

[58] Field of Search ..... 62/298, 448, 291; 165/76

[56] References Cited

U.S. PATENT DOCUMENTS

| | | | |
|---|---|---|---|
| 3,012,762 | 12/1961 | Norris | 257/295 |
| 3,481,393 | 12/1969 | Chu | 165/80 |
| 3,575,234 | 4/1971 | Dieckmann | 165/1 |
| 3,722,580 | 3/1973 | Braver | 165/50 |
| 3,977,467 | 8/1976 | Northrup, Jr. | 165/76 X |
| 4,072,187 | 2/1978 | Lodge | 165/48 |
| 4,129,013 | 12/1978 | Hine, Jr. | 165/76 X |
| 4,423,669 | 1/1984 | Bullock et al. | 454/191 |
| 4,474,232 | 10/1984 | Wright et al. | 165/137 |
| 4,549,405 | 10/1985 | Anderson et al. | 62/298 X |
| 4,646,817 | 3/1987 | Van Ee | 165/76 |
| 4,698,982 | 10/1987 | Laios et al. | 62/286 |
| 4,852,362 | 8/1989 | Conry | 62/175 |
| 5,070,704 | 12/1991 | Conry | 62/175 |
| 5,121,613 | 6/1992 | Cox et al. | 62/419 |

*Primary Examiner*—William E. Tapolcai

*Attorney, Agent, or Firm*—Litman, McMahon & Brown

[57] ABSTRACT

A modular air conditioning system with adjustable capacity includes a cooling module, a heating module, and a blower module which can be assembled in any of a plurality of configurations, including a vertical downflow configuration, a vertical upflow configuration, or a horizontal configuration, using the same set of modules. The same set of modules can be operated over a range of cooling capacities by employing a condensing unit of the required capacity connected to the cooling module and by adjusting the airflow volume rate of air transported through the system. A movable restrictor plate is positioned in partial covering relation to a discharge opening of the blower module and is adjusted to achieve the required airflow volume rate.

18 Claims, 3 Drawing Sheets

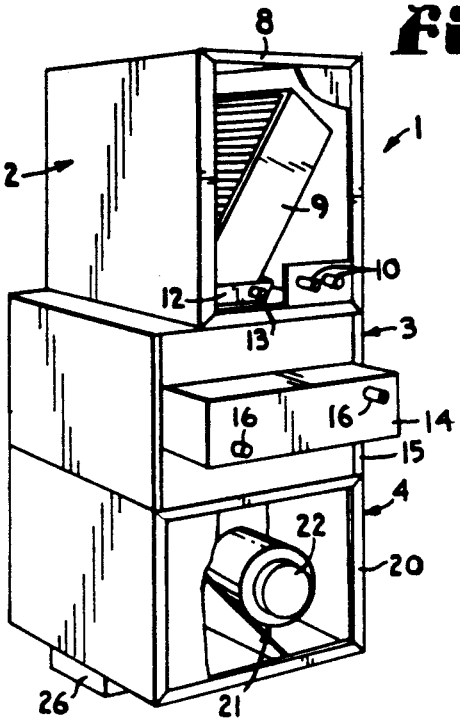
Fig.1.
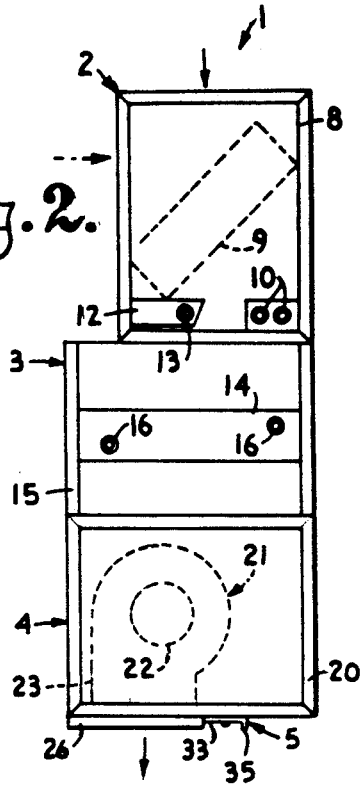
Fig.2.
Fig.4.
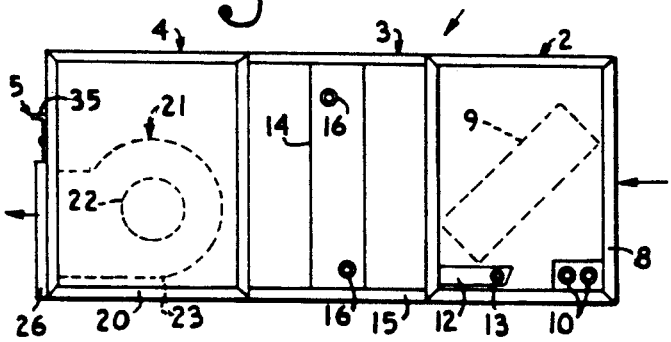
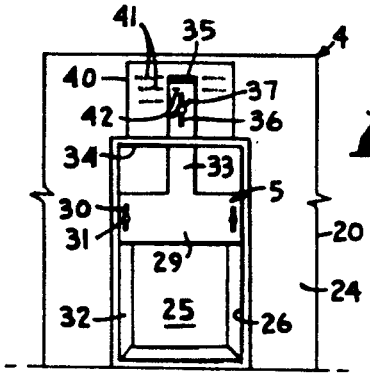
Fig.5.
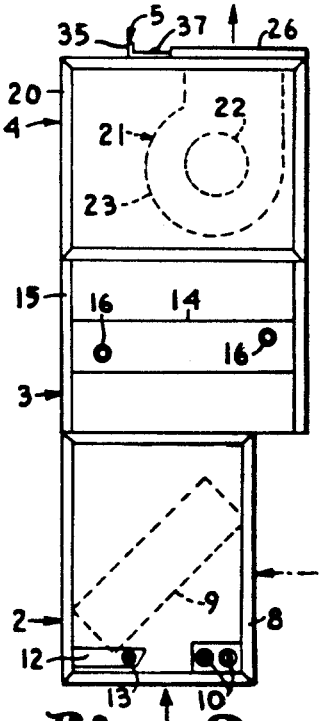
Fig.3.

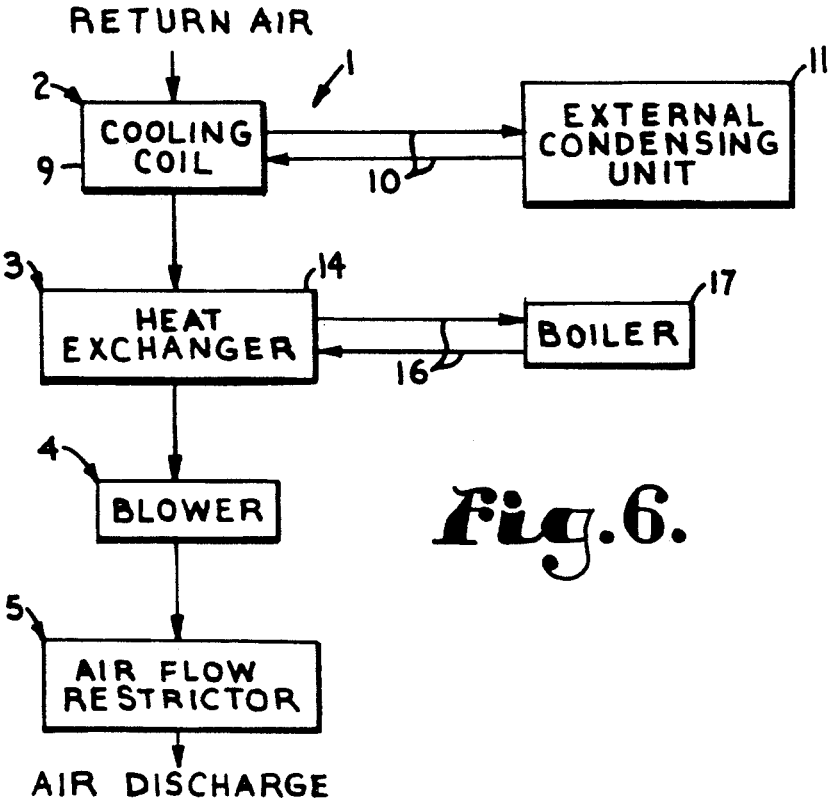
Fig. 6.
Fig. 7.
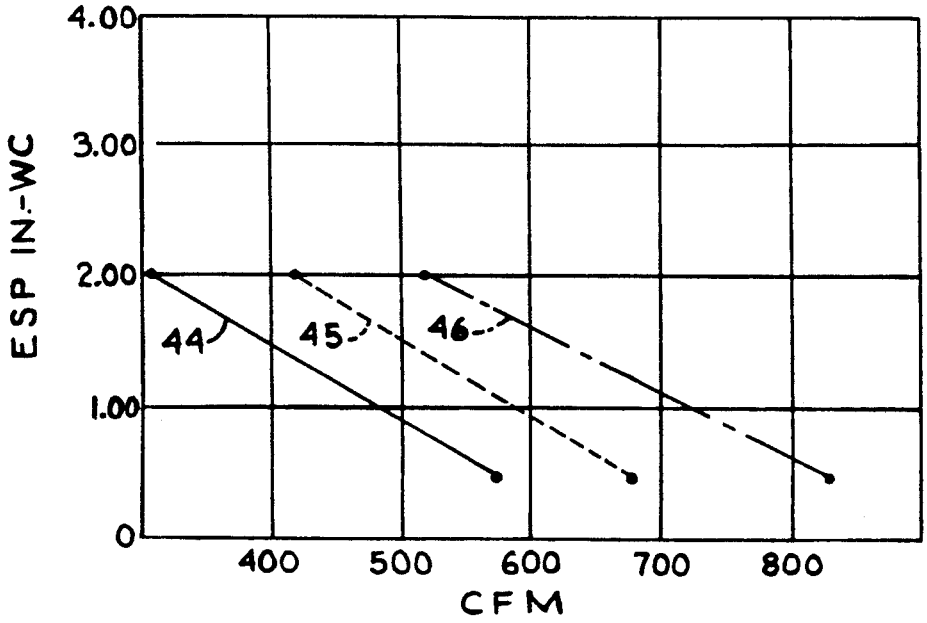

MODULAR AIR CONDITIONING SYSTEM WITH ADJUSTABLE CAPACITY

BACKGROUND OF THE INVENTION

In any manufacturing business, the need to keep inventory to a minimum, while retaining the capability of meeting customers' needs, is an important business objective. More specifically in the HVAC (heating, ventilating, and air conditioning) field, each manufacturer generally produces and stocks a large number of product models in order to provide the configurations and capacities needed to cool and heat structures such as residences and small commercial buildings. Other manufacturers concentrate on medium and large installations. It is common in the industry to provide sizes ranging from two through five ton cooling capacities in typical increments of 2, 2.5, 3, 3.5, 4, and 5 ton evaporator (cooling) or indoor coils with matching outdoor condensing units or outdoor heat pump sections.

To satisfy the variety of applications, the indoor blower coils or heating units that must be provided are in horizontal, vertical upflow, and vertical downflow (counterflow) configurations. To accommodate the size ranges for these three configurations for cooling alone, it would be necessary to stock as many as eighteen models. Additionally, where heating only is desired, individual models can be provided in a great number of sizes. In many cases, both heating and cooling are desired, and this can require either a heating unit complete with heat generating section and blower to which cooling coils are added or a cooling coil with a blower to which a heating section might be added. The product manual or literature of any major HVAC manufacturer will show an extensive listing of products.

In the past, combination air treating installations for heating, cooling, or both have generally been achieved by one of three basic design approaches. First, all-weather air treatment has been provided by adding a cooling coil unit downstream of the air flow from a furnace unit designed primarily for forced warm air heating. Second, it has been common to mount a cooling coil unit having its own independent blower in parallel flow relation to a furnace unit. In a third approach, combination air treating units have been constructed within a single unitary cabinet containing a furnace heat exchanger, a cooling coil unit, a blower unit, and appropriate control devices.

All of these approaches have necessitated substantial design compromises and have sacrificed the optimum efficiencies in either heating or cooling which might otherwise be obtained for each installation and its particular use demands. For example, a system that is designed primarily for forced air heating does not have sufficient air handling capacity to perform adequately for air cooling. The differences between heating and cooling requirements vary greatly in buildings of various types and different occupancies such that it is often difficult to obtain an optimum combination of heating and cooling by simply adding a cooling unit onto an existing forced air heating system.

Although the use of a separate blower-powered cooling coil added in parallel with an existing forced air furnace will provide both good heating and cooling performance, such structures have been expensive and bulky. In many homes, the available space for utility installations has not been sufficient for such parallel arrangements. Further, the use of flow selection dampers to change over between heating and cooling has introduced sources of air leakage, and such dampers are costly to install and to service.

The third approach of large and unitary combination structures has been unacceptable for general domestic use, because, from a manufacturing and sales standpoint, it is a practical impossibility to maintain an adequate inventory of the number of different combinations which would be required for various fuels and heating capacities, various cooling capacities, and various air handling rates. From the point of view of some customers, it has been an economic burden to initially purchase a complete combination unit rather than to first install a heating system and add cooling capability at some later date when the added expenses can be more easily assumed. Additionally, there are problems for installers in fitting such unitary combination units into existing utility spaces and for home builders to design the required space for such units.

SUMMARY OF THE INVENTION

The present invention is a modular air conditioning system which can be assembled in a number of configurations and which can be adjusted for a range of airflow volume capacities. This allows a manufacturer, distributor, or contractor to meet the requirements of a relatively wide range of installations with a greatly reduced catalog of models.

Each system generally includes a heating module, a cooling coil or module, and a blower which can be assembled in a horizontal configuration, a vertical upflow configuration, or a vertical downflow, or counterflow, configuration. The cooling module is connected to an outdoor condensing unit of a size within a selected range, such as from two to three tons (24,000 to 36,000 BTU). The airflow volume rate is adjusted by a variable restrictor plate according to the cooling capacity of the condensing unit employed to result in a constant airflow volume rate per unit of cooling capacity, such as 200 cubic feet per minute (CFM) per ton.

The variable restrictor plate is slidably mounted across the discharge opening of the blower module to vary the area according to the airflow volume rate required for the cooling capacity desired. Preferably, a control handle of the restrictor plate extends through a slot in a plenum connection of the blower module. An index mark on the control handle may be matched with one of a number of graduation marks on a label on the wall above the discharge opening to indicate the proper setting of the restrictor plate for the cooling capacity desired. The restrictor plate may be fixed at the desired setting by means such as a screw or similar fastener extending through a slot in the control handle.

OBJECTS AND ADVANTAGES OF THE INVENTION

The principal objects of the present invention are: to provide an improved system for thermal conditioning of air; to provide, particularly, a modular air conditioning system with adjustable capacity over a selected range using, to a large degree, the same set of components; to provide, particularly, an indoor air handling system of a central air conditioning system including a cooling or refrigerant coil module, a heating module, and a blower module which can be assembled into an indoor air handling system in a horizontal configuration, a vertical upflow configuration, or a vertical downflow configuration using the same modules; to provide such an indoor air handling system which can be adapted to provide a range of cooling capacities using the same modules by employing an appropriate sized outdoor condensing unit; to provide such a system wherein the airflow volume rate can be adjusted according to the cooling capacity of the system to achieve a desired airflow volume rate per unit of cooling capacity; to provide such a system including a movable restrictor plate over the discharge opening of the blower module which can be conveniently set to an appropriate position to achieve a desired airflow volume rate; to provide such a system which can employ a wide variety of types of heating and cooling modules; to provide such a system which is adaptable for the use of heat pump types of refrigerant coils and auxiliary heater devices; to provide such a system which is scalable in capacity; to provide such a system which is suitable for use in modernizing existing buildings as well as in new buildings under construction; to provide such a system which is adaptable to high velocity, compact duct systems in addition to conventional low velocity systems; and to provide such a modular air conditioning system with adjustable capacity which is economical to manufacture, which is versatile in installation, which is efficient in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a modular air conditioning system with adjustable capacity which embodies the present invention.

FIG. 2 is a side elevational view of a vertical downflow configuration of the system with a cooling coil and blower shown in phantom lines.

FIG. 3 is a side elevational view of a vertical upflow configuration of the system.

FIG. 4 is a side elevational view of a horizontal configuration of the system.

FIG. 5 is an end elevational view of the configuration of the system shown in FIG. 4 and illustrates details of an adjustable restrictor plate over a discharge opening of the blower module to control the airflow volume rate therethrough.

FIG. 6 is a block diagram of the air conditioning system of the present invention and includes blocks representing an external condensing unit and a boiler.

FIG. 7 is a graph of blower curves related to settings of the restrictor plate for three tonnages of condenser coils used in the system of the present invention.

DETAILED DESCRIPTION OF THE INVENTION

Figure 8:
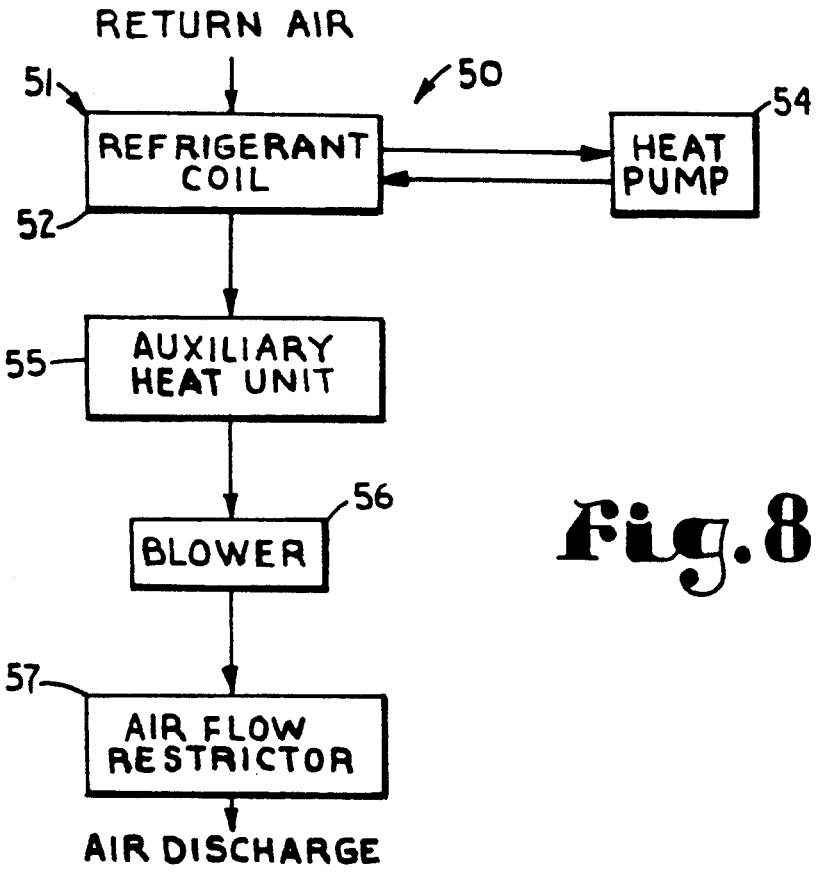
FIG. 8 is a block diagram of an alternative air conditioning system embodying the present invention which incorporates a heat pump and an auxiliary heat unit.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a modular air conditioning system which embodies the present invention. In general, the system 1 includes a cooling module 2, a heating module 3, and a blower module 4. The modules 2, 3, and 4 can be selectively assembled into one of three configurations using the same set of modules: a vertical downflow configuration (FIG. 2), a vertical upflow or counterflow configuration (FIG. 3), or a horizontal configuration (FIG. 4). The blower module 4 includes an airflow volume adjuster assembly 5 to vary the airflow volume rate through the system to match it with the cooling capacity of the system 1.

The cooling module 2 includes a cooling module cabinet 8 having a cooling coil assembly 9 mounted therein. The cooling coil assembly 9 is a type of heat exchanger which sinks away heat from air flowing therethrough. The assembly 9 is connected by refrigerant lines 10 to an external condensing unit 11 (FIG. 6) which is normally mounted outdoors. The cooling module 2 includes a condensation collection or drip pan 12 having a drain connector 13 for connection of a drain hose (not shown) which carries away condensation precipitated onto the cooling coil assembly 9 during cooling operation of the system 1. The cooling module 2 is oriented in the system 1 so that the drip pan 12 is located at a lower side of the module 2 beneath the cooling coil assembly 9.

The cabinet 8 forms a housing for the cooling coil assembly 9 and channels air therethrough. The cooling module cabinet 8 may be provided with interchangeable panels (not shown) to facilitate desired orientation of the cooling module 2. Such interchangeable panels allow for an alternative return air entry on a side of the module, as is indicated by the dotted line arrows in FIGS. 2 and 3. The condensing unit 11 is conventional in construction and operation and may be obtained from a number of manufacturers and distributors, and the cooling coil 9 can be conventional, as will be detailed below.

The illustrated heating module 3 includes a heating coil assembly 14 which is mounted in a heating module cabinet 15. The illustrated heating coil assembly 14 is a heat exchanger which heats air flowing therethrough and is connected by hot water lines 16 to a hot water boiler 17. The cabinet 15 provides a housing for the heating coil assembly 14 and channels air therethrough. The heating coil assembly 14 is conventional in nature and can be obtained from any of a number of manufacturers and distributors. The same heating coil 14 can also be used with a water heater (not shown). Alternative to the heating coil assembly 14, the heating module 3 could employ a steam heating coil (not shown) in combination with a steam boiler instead of the hot water boiler 17, a gas or oil fired forced warm air heating unit (not shown), or an electric heater unit such as a resistance heating element or an electric duct heater (not illustrated).

The illustrated blower module 4 includes a blower module cabinet 20 having a blower assembly 21 mounted therein including a blower motor 22 which is directly connected to a centrifugal blower unit 23. The blower cabinet 20 provides a housing for the motor 22 and blower unit 23 and channels air through the blower unit 23. The cabinet 20 has an end wall 24 (FIG. 5) having an airflow discharge opening 25 formed therethrough. A plenum connection 26 surrounds the discharge opening 25 and provides for connection of an air distribution plenum (not shown) to the blower module 4.

As illustrated in FIGS. 2, 3, and 4, the modules 2, 3, and 4 can be assembled in flow connected relation and oriented in any of three configurations, a vertical downflow configuration shown in FIG. 2, a vertical upflow configuration shown in FIG. 3, or a horizontal configuration shown in FIG. 4. These three configurations are common in the industry and provide for variations in the available mechanical space in newly constructed buildings as well as in existing buildings. The ability to assemble the same set of modules 2, 3, and 4 in three configurations eliminates the need to specially manufacture and warehouse three different models of systems of the same capacity but of different configurations.

The modules 2, 3, and 4 are normally assembled so that in the direction of airflow, the sequence of modules is the cooling module 2, the heating module 3, then the blower module 4. While cool air will not normally harm the heating coil assembly 14, heated air might cause deterioration of components within the cooling coil assembly 9. The present invention is not intended to be restricted to any particular order or sequence of modules but is intended to encompass any practical sequence of the modules 2, 3, and 4.

Additionally, while the system 1 is illustrated using all three modules 2, 3, and 4, there are practical applications of the present invention to systems which require heating-only installations using a heating module 3 with a blower module 4 and cooling-only installations using a cooling module 2 and a blower module 4. The present invention is intended to encompass such heating-only and cooling-only systems.

A system 1 using a set of modules 2, 3, and 4 employing a cooling coil assembly 9, heating coil assembly 14, and blower assembly 21 of a matched capacity can be adjusted to operate over a range of heating and cooling capacities by employing condensing units 11 of different cooling capacities within a range and by adjusting the operating parameters of the boiler 17 in the illustrated system 1 or generally of the heating module 3 employed. For example, the preferred set of modules 2, 3, and 4 can be matched with 2, 2.5, and 3 ton condensing units 11. At least one dimension of each of the modules 2, 3, and 4 of the preferred set is no greater than 13.75 inches to provide sufficient clearance between ceiling joists or studs constructed on standard 16 inch center spacing. By increasing the width of each module by 13 inches, an alternative set of modules 2, 3, and 4 of larger capacity can be matched with 3.5, 4, and 5 ton condensing units 11.

It is necessary to match the airflow through the system 1 to the cooling and heating capacities thereof. Because the condensing units 11 are essentially on/off devices which are generally not capable of adjustment in the field, the airflow volume rate is usually matched to the cooling capacity or tonnage of the condensing unit 11 to achieve a standard airflow volume rate per ton of cooling capacity. In conventional low velocity systems, the ratio is 400 CFM/ton. The system 1 of the present invention has applicability in such conventional low velocity systems and in high velocity/compact duct systems, such as illustrated in U.S. Pat. No. 3,575,234 (incorporated herein by reference). In high velocity systems, the airflow per unit of cooling capacity is 200 CFM/ton. The airflow volume adjuster assembly is used in the system 1 to match the airflow volume rate of the system 1 to the cooling capacity of the condensing unit 11 to achieve the desired ratio.

Referring to FIG. 5, the adjuster assembly 5 includes a restrictor plate 29 which is slidably mounted in partial covering relation to the discharge opening 25. Opposite ends of the plate 29 have guide slots 30 formed therethrough. Fasteners 31 extend through the guide slots 30 and slidably connect the restrictor plate 29 to shoulders 32 on opposite sides of the discharge opening 25. An adjustment arm 33 extends through a slot (not shown) in a wall 34 of the plenum connection 26 to a position therebeyond. An adjustment handle 35 terminates the arm 33 and provides for manual movement of the restrictor plate 29 external to the plenum connection 26 and the blower cabinet 20. A fixing slot 36 is formed through the arm 33 and is parallel and of the same length as the guide slots 30. A releasable fastener 37, such as a screw, bolt and wing nut, or the like, cooperates with the slot 36 to fix the restrictor plate 29 in the adjusted position.

Preferably, an airflow adjustment label 40 is positioned on the blower cabinet wall 24 behind the arm 33 and handle 35. The label 40 has indicia or marks 41 imprinted thereon for correlating the effective area of the discharge opening, and thus the desired airflow volume rate, to the tonnage of the condensing unit 11 employed. In a system 1 intended for operation in the range of two to three tons, the marks 41 may simply be labeled "2 Tons", "2.5 Tons", and "3 Tons"or the like. An index 42 on the arm 33 is positioned to align with the appropriate mark 41 when the restrictor plate 29 is positioned to provide the correct effective area of the discharge opening 25.

FIG. 7 illustrates blower curves 44, 45, and 46 for a selected model of blower assembly 21. The graph relates airflow volume rate and external static pressure (ESP) as the restrictor plate is adjusted. The x-axis is calibrated in CFM (cubic feet per minute), and the y-axis is calibrated in inches-water column (in-WC). The curves 44, 45, and 46 relate respectively to a 2 ton system, a 2.5 ton system, and a 3 ton system.

The capacities of the condensing unit 11 and the boiler 17 are selected respectively according to industry standard guidelines of the cooling load and heating load of the structure to be conditioned. Such guidelines involve factors such as the volume of the space to be conditioned, the seasonal climate of the locale in which the building is located, solar exposure, insulation, occupancy, and the like. For a given capacity of the condensing unit 11, the airflow volume rate is adjusted by proper positioning of the restrictor plate 29. Thereafter, the heating capacity can be adjusted by variation of the water temperature generated in the boiler 17 or the flow rate of the water through the heat exchange assembly 14.

FIG. 8 diagrammatically illustrates a modified modular air conditioning system 50 with adjustable capacity. The system 50 includes a combination heating and cooling module 51 having a refrigerant coil assembly 52 mounted therein. The refrigerant coil 52 communicates over refrigerant lines 53 with a heat pump assembly 54 and heats or cools depending on the direction of the refrigeration cycle of the heat pump assembly 54. In cooler temperate climates, systems based on heat pumps generally incorporate auxiliary heat units, such as electric heater units. The system 50 may include such an auxiliary heat unit in an auxiliary heat module 55 which is airflow connected to the heating/cooling module 51. A blower module 56 is airflow connected to the auxiliary heat module 55 and transports air through the modules 51 and 55 and out into the spaces to be conditioned. The system 50 is provided with an airflow restrictor 57 to match the airflow volume rate therethrough to the cooling capacity of the heat pump 54.

The system 50 is provided in the modules 51, 55, and 56 which may be assembled and oriented in the same configurations as the system 1, including a vertical downflow configuration, a vertical upflow configuration, or a horizontal configuration, using the same set of modules 51, 55, and 56.

The present invention can also be applied to an air conditioning system employing a water chiller unit (not shown) connected to a water coil assembly by water lines. Such a system may employ a any of the types of heater modules described above or may incorporate a water heater unit connected to the water lines and employing controlled valves to control circulation of the cooled or heated water. Although chiller units have not conventionally been applied in cooling tonnages appropriate for household sized installations, there is some interest within the industry for such downsized units. The present invention is intended to encompass modular air conditioning systems employing such chiller units.

It is to be understood that while certain forms of the present invention have been illustrated and described herein, it is not to be limited to the specific forms or arrangement of parts described and shown.

What is claimed and desired to be secured the letters patent is as follows:

1. A modular air temperature system for use in a selected configuration of a horizontal, vertical upflow, or vertical downflow configuration and comprising:

(a) blower module means adapted to transport air therethrough;

(b) airflow control means flow connected to said blower module means and selectively adjustable to control an airflow volume rate through said blower module means;

(c) air temperature module means adapted to change the temperature of air transported therethrough;

(d) said blower module means and said air temperature module means being flow connected in a selected one of said configurations to cause air to be transported through said air temperature module means to change the temperature of said air;

(e) said blower module means includes means forming an airflow discharge opening;

(f) said airflow control means includes restrictor plate means slidably mounted on said blower module means in partial covering relation to said discharge opening, said plate means being slidably positioned to vary an effective area of said opening;

(g) said blower module means includes a plenum connection positioned in surrounding relation to said airflow discharge opening, said plenum connection including a plenum connection wall;

(h) a restrictor plate slot is formed in said plenum connection wall; and (i) a restrictor plate operator handle is connected to said restrictor plate, extends through said restrictor plate slot, and provides for manual adjustment of said restrictor plate.

2. A system as set forth in claim 1 wherein said air temperature module means includes:

(a) air heater module means.

3. A system as set forth in claim 1 wherein said air temperature module means includes:

(a) air cooler module means.

4. A system as set forth in claim 1 wherein said air temperature module means includes:

(a) air heater module means; and (b) air cooler module means.

5. A system as set forth in claim 1 wherein:

(a) said air temperature module means includes a refrigerant coil module of a heat pump system.

6. A system as set forth in claim 5 and including:

(a) an auxiliary heat module flow connected and positioned between said refrigerant coil module and said blower module means.

7. A system as set forth in claim 1 wherein:

(a) said blower module means includes a blower module wall through which said airflow discharge opening is formed;

(b) a restrictor plate adjustment guide label is positioned on said blower module wall in spaced relation to said restrictor plate operator handle;

(c) said handle has a handle index positioned thereon;

(d) said label has a plurality of label indicia positioned thereon; and (e) said handle index and said label indicia being mutually positioned whereby alignment of said handle index with said label indicia positions said restrictor plate respectively to achieve a selected airflow volume rate through said system.

8. A modular air temperature system for use in a selected configuration of a horizontal, vertical upflow, or vertical downflow configuration and comprising:

(a) blower module means adapted to transport air therethrough;

(b) airflow control means flow connected to said blower module means and selectively adjustable to control an airflow volume rate through said blower module means;

(c) air heater module means operable to heat air transported therethrough;

(d) air cooler module means operable to cool air transported therethrough;

(e) said blower module means, said air heater module means, and said air cooler module means being flow connected in a selected one of said configurations to cause air to be transported through said air heater and cooler module means to change the temperature of said air;

(f) said blower module means includes means forming an airflow discharge opening;

(g) said airflow control means includes restrictor plate means slidably mounted on said blower module means in partial covering relation to said discharge opening, said plate means being slidably positioned to vary an effective area of said opening;

(h) said blower module means includes a plenum connection positioned in surrounding relation to said airflow discharge opening, said plenum connection including a plenum connection wall;

(i) a restrictor plate slot is formed in said plenum connection wall; and (j) a restrictor plate operator handle is connected to said restrictor plate and extends through said restrictor plate slot and provides for manual adjustment of said restrictor plate.

9. A system as set forth in claim 8 wherein:

(a) said blower module means includes a blower module wall through which said airflow discharge opening is formed;

(b) a restrictor plate adjustment guide label is positioned on said blower module wall in spaced relation to said restrictor plate operator handle;

(c) said handle has a handle index positioned thereon;

(d) said label has a plurality of label indicia positioned thereon; and (e) said handle index and said label indicia being mutually positioned whereby alignment of said handle index with said label indicia positions said restrictor plate respectively to achieve a selected airflow volume rate through said system.

10. In a modular air temperature system for use in a selected configuration of a horizontal, vertical upflow, or vertical downflow configuration and including blower module means including a blower module wall and adapted to transport air therethrough, air temperature module means adapted to change the temperature of air transported therethrough, said blower module means and said air temperature module means being flow connected in a selected one of said configurations, the improvement comprising:

(a) airflow control means flow connected to said blower module means and selectively adjustable to control an airflow volume rate through said blower module means, said airflow control means including:

(1) means forming an airflow discharge opening in said blower module wall;

(2) a plenum connection positioned in surrounding relation to said airflow discharge opening, said plenum connection including a plenum connection wall;

(3) a restrictor plate slidably mounted within said plenum connection in partial covering relation to said discharge opening, said plate being slidably positioned to vary an effective area of said airflow discharge opening;

(4) a restrictor plate slot formed in said plenum connection wall; and (5) a restrictor plate operator handle connected to said restrictor plate, extending through said restrictor plate slot, and providing for manual adjustment of said restrictor plate to thereby vary an effective area of said airflow discharge opening to thereby vary said airflow volume rate through said system.

11. A system as set forth in claim 10 and including:

(a) a restrictor plate adjustment guide label positioned on said blower module wall in spaced relation to said restrictor plate operator handle;

(b) said handle having a handle index positioned thereon;

(c) said label having a plurality of label indicia positioned thereon; and (d) said handle index and said label indicia being mutually positioned whereby alignment of said handle index with said label indicia positions said restrictor plate respectively to achieve a selected airflow volume rate through said system.

12. A modular air temperature system for use in a selected configuration of a horizontal, vertical upflow, or vertical downflow configuration and comprising:

(a) blower module means adapted to transport air therethrough;

(b) airflow control means flow connected to said blower module means and selectively adjustable to control an airflow volume rate through said blower module means;

(c) air heater module means operable to heat air transported therethrough;

(d) air cooler module means operable to cool air transported therethrough and including a cooling coil and a drain pan positioned in mutually spaced relation;

(e) said air cooler module means being operated only in a selected mutual orientation of said cooling coil and drain pan; and (f) said blower module means, said air heater module mans, and said air cooler module means being flow connected in a selected one of said configurations to cause air to be transported through said air heater and cooler module means to change the temperature of said air, said air cooler module means being positioned with said cooling coil and drain pan in said selected mutual orientation in each of said configurations.

13. A modular air temperature system for use in a selected configuration of a horizontal, vertical upflow, or vertical downflow configuration and comprising:

(a) blower module means adapted to transport air therethrough;

(b) airflow control means flow connected to said blower module means and selectively adjustable to control an airflow volume rate through said blower module means;

(c) air temperature module means adapted to change the temperature of air transported therethrough; and (d) said blower module means and said air temperature module means being flow connected in a selected one of said configurations to cause air to be transported through said air temperature module means to change the temperature of said air;

(e) said blower module means including means forming an airflow discharge opening;

(f) said airflow control means including restrictor plate means slidably mounted on said blower module means in partial covering relation to said discharge opening, said plate means being slidably positioned to vary an effective area of said opening;

(g) said blower module means including a plenum connection positioned in surrounding relation to said airflow discharge opening, said plenum connection including a plenum connection wall;

(h) a restrictor plate slot formed in said plenum connection wall;

(i) a restrictor plate operator handle connected to said restrictor plate means, extending through said restrictor plate slot, and providing for manual adjustment of said restrictor plate means;

(j) said blower module means including a blower module wall through which said airflow discharge opening is formed;

(k) a restrictor plate adjustment guide label positioned on said blower module wall in spaced relation to said restrictor plate operator handle;

(l) said handle having a handle index positioned thereon;

(m) said label having a plurality of label indicia positioned thereon; and (n) said handle index and said label indicia being mutually positioned whereby alignment of said handle index with said label indicia positions said restrictor plate means respectively to achieve a selected airflow volume rate through said system.

14. A system as set forth in claim 13 wherein said air temperature module means includes:

(a) air heater module means.

15. A system as set forth in claim 13 wherein said air temperature module means includes:

(a) air cooler module means.

16. A system as set forth in claim 13 wherein said air temperature module means includes:

(a) air heater module means; and (b) air cooler module means.

17. A system as set forth in claim 13 wherein said air temperature module means includes:

(a) a refrigerant coil module of a heat pump system.

18. A system as set forth in claim 17 and including:

(a) an auxiliary heat module flow connected and positioned between said refrigerant coil module and said blower module means.

* * * * *